US006358656B1

(12) United States Patent
Srinivasan et al.

(10) Patent No.: US 6,358,656 B1
(45) Date of Patent: Mar. 19, 2002

(54) DEVELOPER OR TONER COMPRISING A PARTICLE HAVING A TREATMENT

(75) Inventors: Satyanarayan Srinivasan; Dinesh Tyagi; William Keith Goebel, all of Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/644,331

(22) Filed: Aug. 23, 2000

(51) Int. Cl.[7] ..... G03G 9/107

(52) U.S. Cl. ..... 430/108.6; 430/111.33; 430/137.21

(58) Field of Search ..... 430/110, 111, 430/108.6, 111.33, 137.21

(56) References Cited

U.S. PATENT DOCUMENTS

| | | | | | |
|---|---|---|---|---|---|
| 5,500,320 | A | * | 3/1996 | Saha | 430/111.33 |
| 5,747,211 | A | * | 5/1998 | Hagi et al. | 430/110 |
| 5,776,647 | A | * | 7/1998 | Kido et al. | 430/110 |
| 5,905,011 | A | * | 5/1999 | Kurose et al. | 430/110 |

* cited by examiner

*Primary Examiner*—John Goodrow
(74) *Attorney, Agent, or Firm*—Lawrence P. Kessler

(57) ABSTRACT

The present invention generally relates to a treatment for an electrographic toner. The treatment can include at least one titanium dioxide particle having a BET surface area of at least about 70 $m^2/g$, and at least one silica particle.

24 Claims, No Drawings

DEVELOPER OR TONER COMPRISING A PARTICLE HAVING A TREATMENT

FIELD OF THE INVENTION

This invention relates generally to toners, and particularly toner treatment compositions.

BACKGROUND OF THE INVENTION

Toners can be used for various applications, including electrographics. Such applications can require toners for printing high quality text and half tone images (see S. Sata et al., "Study on the Surface Properties of Polyester Color Toner," *IS&T NIP*13, 149–152 (1997) and Nash, R. & Muller, R. N. "The Effect of Toner and Carrier Composition on the Relationship Between Toner Charge to Mass Ratio and Toner Concentration," *IS&T NIP* 13, 112–120 (1997).

In electrographic applications, it is generally desirable to reduce toner particle size in a developer to improve image quality. However, the smaller the toner particles, the more likely that the particles will pack in an electrographic apparatus, such as a copier, and not flow properly, thus adversely affecting the apparatus's operation and image quality.

One solution can be adding fumed silica as a lubricant to reduce friction and packing, and thus improve the fluidity of the pre-toner particles. However, the use of fumed silica can result in an increase in the negative charge of the treated toner particles. Such a negative charge increase can impede transport of a particle, particularly in multilayer transfer processes in color printers, from one charged surface to another during electrographic operations, e.g., from the developer station to the photoconductor, or from the photoconductor onto the paper.

Alternatively, toner particles can be treated with titanium dioxide. Such formulations are disclosed in U.S. Pat. Nos. 4,943,506, 5,155,000, 5,192,637, 5,429,902, 5,705,303 and 5,747,211. Titanium dioxide treated toners generally have lower charges, and thus are easier to transport through the electrographic apparatus. However, such titanium dioxide treated toners, partly due to their low charge, can create significant airborne dust when replenishing an aged developer, which can include a carrier and a toner, with fresh toner. Such replenishment methods are disclosed in U.S. Pat. Nos. 3,938,992 and 3,944,493.

Attempts have been made to treat toner particles with a combination of silica and titanium dioxide mixtures, as disclosed in U.S. Pat. Nos. 5,272,040, 5,776,646 and 4,623,605, but these efforts have been largely unsuccessful in simultaneously reducing negative toner particle charge and rebuilt airborne dust levels.

SUMMARY OF THE INVENTION

The present invention provides a treatment for an electrographic toner. Generally, the treatment includes at least one titanium dioxide particle having a BET surface area of at least about 70 $m^2/g$ and/or a diameter no more than about 20 nm, and at least one silica particle. Preferably, the titanium dioxide particle has a BET surface area of at least about 80 $m^2/g$, and more preferably a BET surface area of from about 75 to about 105 $m^2/g$. In addition, the titanium dioxide particle generally has a diameter of no more than about 15 nm, and preferably still, has a diameter of about 7 to about 12 nm. Preferably, the weight ratio of silica particles to titanium particles can be from about 1:0.1 to about 1:2, and more preferably, the weight ratio of silica particles to titanium particles can be from about 1:0.5 to about 1:1.5, and optimally, about 1:1.

The present invention additionally provides an electrographic toner, including at least one toner particle. This particle can include a binder, a pigment and a charge control agent. The toner particle can be treated with the titanium dioxide-silica treatment as discussed above. Preferably, the treatment is applied to the surface of the particle. What is more, the electrographic toner can have a BET surface area to Coulter surface area of 1:1 to 3:1, and 8 micron average particle size. The invention is further directed to a developer including the electrographic toner as discussed above and a carrier. The developer preferably exhibits a charged mass of 10–40 (microCoulomb)/gram, and a rebuilt charge at 10 minutes of less than −45 (microCoulomb)/gram and less than 5 milligrams of generated airborne dust after rebuilding.

Additionally, the present invention provides a method of making a toner. The method includes providing at least one toner particle and treating with at least one titanium dioxide particle having a BET surface area of at least about 70 $m^2/g$ and at least one silica particle.

Definitions

"Airborne dust" refers to dust that is produced when fresh replenishment toner is mixed with aged developer.

As used herein, the term "electrographic" is generally interchangeable with the terms "electrostatographic", "electrophotographic", and "xerographic".

"Charge characteristics" refers to the ratio of charge to mass of a toner in a developer. Preferably, an 8 micron (volume average) particularized toner has a charged mass ratio of 10–50 microCoulomb/gram, and more preferably, 20–45 microCoulomb/gram.

The "Coulter counter" measures the number in volume of average particle sizes and the specific surface area of a toner. This measurement is made by suspending the particles in a conductive liquid and monitoring the electrical current between two electrodes emerged in the conductive liquid on either side of a small aperture. The suspension of particles flows through the aperture. Each particle changes the impedance between the electrodes and produces an electric pulse of short duration having a magnitude essentially proportional to the particle volume. The series of pulses are electrically scaled, counted and accumulated in a number of size-related channels, thereby producing a size distribution curve. Assuming the particles are spherical, the Coulter counter also estimates a specific surface area of the toner particles.

The "BET" is a measurement of a particles surface area in square meters per gram. This procedure includes degassing a sample overnight under helium gas at 10 psi pressure at room temperature and then subjecting the degassed sample to a flowing mixture of about 70 mol % helium carrier gas and about 30 mol % nitrogen absorbate gas at a pressure of 7 psi and −195 degrees C. The amount of nitrogen adsorbed is used with the BET equation to calculate the surface area. What is more, the ratio of the BET surface area to the Coulter surface area can be used as a measure of the toner shape irregularity.

As used herein, the term "rebuilt charge" refers to the charge associated with the fresh replenishment toner particles after introducing and mixing with carrier from an aged developer.

Discussion

One embodiment of the invention is a treatment composition for an electrographic toner. The treatment can include at least one titanium dioxide particle having a BET surface area of at least about 70 $m^2/g$ and preferably having a BET surface area of from about 75 to about 105 $m^2/g$. What is more, preferably the treatment has at least one titanium dioxide particle having a BET of at least about 80 $m^2/g$. Generally, multiple titanium dioxide particles are used. Furthermore, the titanium dioxide particles used in the present invention preferably have a diameter of not more than about 20 nm, preferably not more than about 15 nm, and more preferably have a diameter ranging from about 7 to about 12 nm. An example of such titanium dioxide particles are those sold under the trade designation MPT313 by Isihara Sangyo Kaisha Ltd of Osaka, Japan.

The treatment can further include a silica particle. Generally, multiple silica particles are used. Preferably, such silica particles have a BET surface area of from about 50-about 350 $m^2/g$ and an average particle diameter of about 5–about 40 nm, and more preferably an average particle diameter of about 8–about 20 nm. Examples of such silica particles are those sold under the trade designations R972, RY200 and RY300 from Degussa Corporation, of Akron, Ohio.

Optionally, the silica and/or titanium dioxide particles may be treated with one or more organic or silicone compounds in an amount, preferably, of between about 0.1 to about 20 weight percent of the total weight of silica and/or titanium dioxide particles. Examples of the organic or silicone compounds include silicone oil, polydimethylsiloxane, alkylsilane, and/or alkylsilazane.

The ratio of the weight of silica particles present on the surface of said toner to the weight of titanium dioxide particles on the surface is preferably from about 1:0.1 to about 1:1.5. Preferably, the ratio of the weight of silica particles present on the surface of said toner to the weight of titanium dioxide particles on the surface can range from about 1:0.5 to about 1:1.5. More preferably, the ratio of the weight of silica particles present on the surface of said toner to the weight of titanium dioxide particles on the surface is about 1:1.

Generally, the treatment composition is applied to a toner. The treatment can be applied by mixing, or otherwise coating the toner particles with the treatment composition. In one desired embodiment, the toner is dry blended with the surface treatment composition of the present invention in a high speed lab mixer from 1000–3000 rpm, preferably for 30 to 60 seconds. The silica and titanium dioxide particles can be from about 0.1 to about 10 wt. % of the total toner weight. Preferably, the amount of surface treatment to toner can vary from a weight percent of about 0.1 to about 5, more preferably from a weight percent of about 0.5 to about 3, and optimally from a weight percent of about 1.5 to about 2.5 of the total toner weight.

Preferably, the toner includes a binder, and optionally includes a colorant, a charge control agent, and an anti-blocking agent, which can be blended to form toner particles. Binders can be selected from a wide variety of materials, including condensation polymers such as polyesters as well as both natural and synthetic resins and modified natural resins, as disclosed, for example, in U.S. Pat. No. 4,076,857. Other useful binders can include the crosslinked polymers as disclosed in U.S. Pat. Nos. 3,938,992 and 3,941,898. The crosslinked or noncrosslinked copolymers of styrene or lower alkyl styrenes with acrylic monomers such as alkyl acrylates or methacrylates may also be used. Numerous polymers suitable for use as toner resins are disclosed in U.S. Pat. No. 4,833,060. Consequently, the teachings of U.S. Pat. Nos. 3,938,992, 3,941,898, 4,076,857; and 4,833,060 are hereby incorporated by reference in their entirety. In addition, another desired binder is a bis-phenol based polyester of the acid value between 1 and 40. The toner typically comprises 85 to 95 weight percent by weight of the binder. Such a binder can be propoxylated bisphenol-A combined with furmaric acid.

Optionally, the binder can be compounded with a colorant, i.e., a dye or pigment, either in the form of a pigment flush (a special mixture of pigment press cake and resin well-known to the art) or pigment-resin masterbatch, as well as any other desired addenda known to the art. If a developed image of low opacity is desired, no colorant need be added. Normally, however, a colorant can be included and it can, in principle, be any of the materials mentioned in Colour Index, Vols. I and II, 2nd Edition (1987). Carbon black can be especially useful while other colorants can include pigment blue, pigment red, and pigment yellow. Specific colorants can include copper phthalocyanine, and pigment blue sold under the trade designation LUPRETON BLUE SE1163. The amount of colorant, if used, can vary over a wide range, e.g., from about 1 to about 25, and preferably from about 3 to about 20 weight percent of the toner component. Combinations of colorants may be used as well.

The toner can also contain charge control agents. Particular charge control agents are disclosed in U.S. Pat. Nos. 3,893,935 and 4,206,064, and British Pat. No. 1,501,065, the teachings of which are incorporated herein by reference in their entirety. Furthermore, quaternary ammonium salt charge agents as disclosed in Research Disclosure, No. 21030, Volume 210, October 1981 (published by Industrial Opportunities Ltd., Homewell, Havant, Hampshire, PO9 1EF, United Kingdom) may also be used. Specific charge control agents can include aluminum and/or zinc salts of di-t-butylsalicylic acid. Preferably, the charge control agent is, if used, provided in an amount of about 0.2–about 5% wt. of the total toner weight and preferably in an amount of about 1–about 3 weight percent of total toner weight.

What is more, the toner can optionally contain other additives, such as antiblocking agents and/or waxes, such as polypropylene, polyethylene, or copolymers and blends thereof.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sep. 5, 1979, to J. Ugelstad, as well as by suspension polymerization, such as the method disclosed in U.S. Pat. No. 4,833,060, the teachings of which are incorporated by reference herein in their entirety.

Furthermore, it is desirable that the toner has a ratio of BET surface area to Coulter surface area of about 1:1 to about 5:1, and more preferably has a ratio of about 1:1 to about 3:1, and even more preferably a ratio of about 1:1 to about 1.5:1. Preferably, the median volume average particle size of the toner is in the range of about 2 to about 20 microns, preferably about 7.8 to about 8.5 microns, and a specific surface area of about 0.7–0.8 $m^2/mL$ as measure by Coulter.

An exemplary toner formulation is depicted below in Table 1.

TABLE 1

| Component | Parts by weight | Supplier |
|---|---|---|
| Polyester Binder | 100 | Reichhold Chemicals Inc. |
| Pigment | 5 | BASF Corporation |
| Charge Control Agent (E88) | 2 | Orient Chemical Corporation |

In one embodiment of the invention, the electrographic toner polymer particles are prepared by means of an organic solvent/aqueous chemical process, a process frequently referred to as "limited coalescence" (LC process). In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation. The resultant particles are then isolated, washed and dried.

In the practice of this technique, toner particles can be prepared from any type of polymer that is soluble in a solvent and immiscible with water. Thus, the size and distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131 to Nair et al. The method can involve dissolving a polymer material in an organic solvent and optionally a pigment and a charge control agent to form an organic phase, dispersing the organic phase in an aqueous phase comprising a particulate stabilizer and homogenizing the mixture, evaporating the solvent, and washing and drying the resultant product.

If a colorant is used in the toner, the mixture of binder and colorant may be melt compounded and milled to disperse the colorant and other additives in the toner. The mass may be cooled, pulverized into lumps and finely ground. The resulting toner particles can range in diameter from about 0.5 to about 25 $\mu$m with an average size of from about 1 to about 16 $\mu$m.

Preferably, the toners are combined with a carrier to form a developer. Preferably, the average particle size ratio of carrier to toner particles is from about 15:1 to about 1:1. However, carrier-to-toner average particle size ratios of as high as about 50:1 can be useful. Preferably, the volume average particle size of the carrier particles can range from about 5 to about 50 microns.

U.S. Pat. Nos. 4,546,060 and 4,473,029, the disclosures of which are incorporated herein by reference, describe that the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO_6Fe_2O_3$ wherein M is barium, strontium or lead. However, magnetic carriers useful in the invention can include soft ferrites, hard ferrites, magnetites, sponge iron, etc. In addition, the magnetic carrier ferrite particles can be coated with a polymer such as mixtures of Kynar/poly (methyl methacrylate) or silicone resin type polymer. Preferably, the toner is present in an amount of about 2 to about 20 percent by weight of the developer and preferably between 5 and 12 weight percent.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius; and, unless otherwise indicated, all parts and percentages are by weight.

The entire disclosures of all applications, patents and publications, cited above or below, are hereby incorporated by reference.

EXAMPLES

In the following examples of the present invention, the following titanium dioxide of Table 1 is mixed with each of the silicas from Table 2 to create three treatments.

TABLE 1

| Inorganic Oxide | Name | BET Surface area ($m^2/g$) | Average Primary Particle Size (nm) | Reagent |
|---|---|---|---|---|
| Ultrafine Titanium Dioxide | TITANIUM DIOXIDE MPT313 (T4) | 90 ± 15 | 7–12 | Hexyltrimethoxysilane |

TABLE 2

| Inorganic Oxide | Name | BET Surface area ($m^2/g$) | Average Primary Particle Size (nm) | Reagent |
|---|---|---|---|---|
| Ultrafine Silica | SILICA R972 (S1) | 130 ± 25 | 16–18 | Dichlorodimethylsilane |
| Ultrafine Silica | SILICA RY200 (S2) | 100 ± 20 | 11–13 | Polydimethylsiloxane |
| Ultrafine Silica | SILICA RY300 (S3) | 200 ± 20 | 6–8 | Polydimethylsiloxane |

In addition, comparative examples 4–25 were made by making various combinations of a titanium oxide from TABLE 3 below with a silica from TABLE 2.

TABLE 3

| Inorganic Oxide | Name | BET Surface area ($m^2/g$) | Average Primary Particle Size (nm) | Reagent |
|---|---|---|---|---|
| Ultrafine Titanium Dioxide | TITANIUM DIOXIDE T805 (T1) | 50 ± 15 | 20–30 | Octyltrimethoxysilane |
| Ultrafine Titanium Dioxide | TITANIUM DIOXIDE MPT311 (T2) | 59.5 | 20–30 | Hexyltrimethoxysilane |

TABLE 3-continued

| Inorganic Oxide | Name | BET Surface area ($m^2/g$) | Average Primary Particle Size (nm) | Reagent |
|---|---|---|---|---|
| Ultrafine Titanium Dioxide | TITANIUM DIOXIDE MPT312 (T3) | 65 | 10–30 | Hexyltrimethoxy-silane |

In the following inventive and comparative examples, polyester toners from propoxylated bisphenol-A and fumaric acid are powder blended, melt compounded, ground in an air jet mill, and classified by particle size. The resulting toner has a median volume average particle size within the range of 2 to 20 microns. The toners are subsequently surface treated by dry blending 25 gm of toner with varying amounts of surface treatment agents in a high speed lab mixer. The components were mixed for 30 to 60 seconds in a high-speed lab scale Waring mixer at 1000 to 3000 rpm. The inventive examples of surface treated toners are depicted in Table 4. Comparative examples of untreated and surface treated toners are depicted in Table 5.

TABLE 4

| Example | Toner Weight (gm) | Ultrafine silica SILICA S1 particles Weight (gm) | Ultrafine silica SILICA S2 particles Weight (gm) | Ultrafine silica SILICA S3 particles Weight (gm) | Ultrafine titania TITANIA T4 particles Weight (gm) |
|---|---|---|---|---|---|
| 1 | 25 | 0.25 | 0 | 0 | 0.25 |
| 2 | 25 | 0 | 0.25 | 0 | 0.25 |
| 3 | 25 | 0 | 0 | 0.25 | 0.25 |

TABLE 5

| Comparative Example | Toner Weight (gm) | Ultrafine silica SILICA S1 particles Weight (gm) | Ultrafine silica SILICA S2 particles Weight (gm) | Ultrafine silica SILICA S3 particles Weight (gm) | Ultrafine titania TITANIA T4 particles Weight (gm) |
|---|---|---|---|---|---|
| 4 | 25 | 0 | 0 | 0 | 0 |
| 5 | 25 | 0.25 | 0 | 0 | 0 |
| 6 | 25 | 0.25 | 0 | 0 | 0.125 |
| 7 | 25 | 0.25 | 0 | 0 | 0.25 |
| 8 | 25 | 0.25 | 0 | 0 | 0.5 |
| 9 | 25 | 0 | 0 | 0 | 0.25 |
| 10 | 25 | 0 | 0.25 | 0 | 0 |
| 11 | 25 | 0 | 0.25 | 0 | 0.25 |
| 12 | 25 | 0 | 0.25 | 0 | 0.5 |
| 13 | 25 | 0 | 0 | 0.25 | 0 |
| 14 | 25 | 0 | 0 | 0.25 | 0.25 |
| 15 | 25 | 0 | 0 | 0.25 | 0.5 |
| 16 | 25 | 0.25 | 0.25 | 0 | 0 |
| 17 | 25 | 0.25 | 0.5 | 0 | 0 |
| 18 | 25 | 0 | 0.25 | 0 | 0 |
| 19 | 25 | 0.25 | 0 | 0.25 | 0 |
| 20 | 25 | 0.25 | 0 | 0.5 | 0 |
| 21 | 25 | 0 | 0 | 0.25 | 0 |
| 22 | 25 | 0.25 | 0 | 0 | 0.5 |
| 23 | 25 | 0 | 0.25 | 0 | 0.5 |
| 24 | 25 | 0 | 0 | 0.25 | 0.5 |
| 25 | 25 | 0 | 0 | 0 | 0.25 |

Tests with Developers Incorporating Toner Examples

Electrographic developers are prepared by mixing toner treated as described above with hard magnetic ferrite carrier particles coated with silicone resin. Developers are made at a concentration of 8 weight percent toner, and 92 weight percent carrier particles. Carriers employed herein are hard magnetic ferrite carrier particles coated with a polymer such as a silicone resin type polymer or poly(vinylidene fluoride) or poly(methyl methacrylate) or mixtures of poly(vinylidene fluoride) and poly(methyl methacrylate).

Charge and Dust Measurements

Typically a 4 gram developer sample at 8% toner concentration are prepared by mixing 3.2 g carrier and 0.8 g toner. The developer is mixed on a device that simulates the mixing that occurs in a printer developer station to charge the toner particles. The triboelectric charge of the toner is then measured after 2, 10, and 60 minutes of mixing using a MECCA device. The MECCA device comprises a set of parallel plate electrodes, spaced 1 cm apart by insulative plastic spacers. A weighed developer sample (typically 0.1 grams) is placed on the lower electrode, which is connected to a power supply typically set to 2000V, with the same polarity as that of the toner to be measured. The upper electrode is connected to a coulomb-meter. The developer sample is magnetically agitated by means of a 60 Hz AC coil positioned under the lower electrode. Developer is agitated in the presence of the electric field, resulting in the toner transferring to the upper plate, where the amount of charge transferred is measured with the coluombmeter. The toner collected is weighed, the measured charge is divided by the measured weight to calculate charge per mass in units of microcoulombs per gram, and the measured weight of toner is divided by the starting weight of developer to calculate the toner concentration.

The amount of dust is measured at the 10-minute level as milligram of toner that dusts off per gram of admixed fresh toner. The developer is subsequently stripped of all toner and rebuilt with fresh toner. The triboelectric charge of the toner is then measured after 2 and 10 minutes of mixing. The amount of dust is again measured at the 10-minute level as mg of toner that dusts off per gram of admixed fresh toner.

In a printer, replenishment toner is added to the developer station to replace toner removed in the process of printing copies. This toner is uncharged and gains a triboelectric charge by mixing with the developer. During this mixing process uncharged or low charged particles can become airborne and result in background on prints or dust contamination within the printer.

A "dusting test" is performed during experimentation to evaluate the potential for a replenishment toner to form background or dust. The 4 g developer sample at 8% toner concentration (3.2 g carrier+0.8 g toner) is exercised on a rotating shell and magnetic core developer station. After 10 minutes of exercising, 0.4 g of fresh uncharged replenishment toner was added to the developer. A fine filter over the developer station then captures airborne dust that is generated when the replenishment toner is added, and the dust collected is weighed as milligrams of dust per 0.4 grams of added replenishment toner. The lower the value for this "dust" measurement corresponds to a better toner performance. Typically, low values of dust (less than 10 milligrams per gram of fresh added toner) in addition to low levels of toner charge (20–41 $\mu$C/g) are desirable.

The results of developers of the present invention are depicted in TABLE 6, comparative developers are depicted in TABLE 7, and other developer examples in TABLE 8.

TABLE 6

| Example | Toner Weight (gm) | SILICA S1 Weight (gm) | SILICA S2 Weight (gm) | SILICA S3 Weight (gm) | TITANIA T1 Weight (gm) | FRESH Q/m 2' μC/g | FRESH Q/m 10' μC/g | FRESH Q/m 60' μC/g | FRESH Dust mg | REBUILT Q/m 2' μC/g | REBUILT Q/m 10' μC/g | REBUILT Dust mg |
|---|---|---|---|---|---|---|---|---|---|---|---|---|
| 1 | 25 | 0.25 | 0 | 0 | 0.25 | −24.5 | −45.4 | −44.1 | 1.1 | −27.3 | −19.3 | 3.3 |
| 2 | 25 | 0 | 0.25 | 0 | 0.25 | −27.3 | −56.9 | −47.6 | 13 | −30.1 | −38 | 1.5 |
| 3 | 25 | 0 | 0 | 0.25 | 0.25 | −24.1 | −53.9 | −60.3 | 5.2 | −28.2 | −40.2 | 3.8 |

TABLE 7

| Comparative Example | Toner Weight (gm) | SILICA S1 Weight (gm) | SILICA S2 Weight (gm) | SILICA S3 Weight (gm) | TITANIA T1 Weight (gm) | TITANIA T2 Weight (gm) | TITANIA T3 Weight (gm) | TITANIA T4 Weight (gm) | FRESH | | | REBUILT | | |
|---|---|---|---|---|---|---|---|---|---|---|---|---|---|---|
| 4 | 25 | 0 | 0 | 0 | 0 | | | | −26 | −54.1 | −72.6 | 32.3 | −29.9 | −52.5 | 15.5 |
| 5 | 25 | 0.25 | 0 | 0 | 0 | | | | −32 | −62.3 | −76.8 | 12.5 | −40 | −61.8 | 8.5 |
| 6 | 25 | 0.25 | 0 | 0 | 0.125 | | | | −31.7 | −56.2 | −70.6 | 14.7 | −39.3 | −55.9 | 8.3 |
| 7 | 25 | 0.25 | 0 | 0 | 0.25 | | | | −28.3 | −59.6 | −65.1 | 16.8 | −30.7 | −41.6 | 15.3 |
| 8 | 25 | 0.25 | 0 | 0 | 0.5 | | | | −23.4 | −50.7 | −50.4 | 29.7 | −23.6 | −24.9 | 30.4 |
| 9 | 25 | 0 | 0 | 0 | 0.25 | | | | −7.5 | −23.5 | −39 | 48.4 | −6.5 | −20.8 | 111.6 |
| 10 | 25 | 0 | 0.25 | 0 | 0 | | | | −36.1 | −96.3 | −89.2 | 0.4 | −57.4 | −91.8 | 0.8 |
| 11 | 25 | 0 | 0.25 | 0 | 0.25 | | | | −23.6 | −71.1 | −75.5 | 9.2 | −27.5 | −58.9 | 5.1 |
| 12 | 25 | 0 | 0.25 | 0 | 0.5 | | | | −18.7 | −52.7 | −58.7 | 15.2 | −22.2 | −40.4 | 7.6 |
| 13 | 25 | 0 | 0 | 0.25 | 0 | | | | −41.3 | −78.7 | −98.6 | 0 | −52.4 | −100.1 | 0 |
| 14 | 25 | 0 | 0 | 0.25 | 0.25 | | | | −20.4 | −74.2 | −18.7 | 2.6 | −26.2 | −64.5 | 4.5 |
| 15 | 25 | 0 | 0 | 0.25 | 0.5 | | | | −15.1 | −59.3 | −66.9 | 32.8 | −19.8 | −49.9 | 17.8 |
| 16 | 25 | | 0.25 | 0 | | 0.25 | | | −30.4 | −73.9 | −70.4 | 3.5 | −32.1 | −58.7 | 4 |
| 17 | 25 | | 0.25 | 0 | | 0.50 | | | −21 | −42.7 | −29.6 | 90.4 | −19.5 | −24.3 | 86.6 |
| 18 | 25 | 0 | | 0 | | 0.25 | | | −6.4 | −45.1 | −57.7 | 199.2 | −7.8 | −34.2 | 179.1 |
| 19 | 25 | | 0.25 | | | | 0.25 | | −25.3 | −72.9 | −70.5 | 6.4 | −28.9 | −56.5 | 6.6 |
| 20 | 25 | | 0.25 | | | | 0.5 | | −13.5 | −39.6 | −29.5 | 160.5 | −12.2 | −20 | 132.2 |
| 21 | 25 | 0 | 0 | | | | 0.25 | | −3.2 | −51.8 | −78.6 | 244.7 | −5.2 | −42.1 | 229 |

TABLE 8

| Example | Toner Weight (gm) | SILICA S1 Weight (gm) | SILICA S2 Weight (gm) | SILICA S3 Weight (gm) | TITANIA T1 Weight (gm) | TITANIA T2 Weight (gm) | TITANIA T3 Weight (gm) | TITANIA T4 Weight (gm) | FRESH | | | REBUILT | | |
|---|---|---|---|---|---|---|---|---|---|---|---|---|---|---|
| 22 | 25 | 0.25 | 0 | 0 | | | | 0.5 | −19.5 | −7.6 | −7.8 | 45 | −11.4 | −3 | 122.1 |
| 23 | 25 | 0 | 0.25 | 0 | | | | 0.25 | −20.1 | −9.6 | −12.2 | 52.5 | −11.6 | −6.2 | 53.1 |
| 24 | 25 | 0 | 0 | 0.25 | | | | 0.5 | −17.8 | −11.2 | −14.6 | 54.5 | −10 | −10.5 | 45.6 |
| 25 | 25 | 0 | 0 | 0 | | | | 0.25 | −13.5 | −14.4 | −45.8 | 58.9 | −13.4 | −16.6 | 16.2 |

DISCUSSION OF EXAMPLES

In accordance with the present invention, TABLE 6 depicts Examples 1–3 treated with a mixture of either silicas S1, S2 or S3 and titania T4, i.e. titanium dioxide with a BET of at least about 70 $m^2/g$. As a result, the developer incorporating the treated toner not only has lower Q/m (less than −41 μC/g), but also lower dust (less than 5 mg). This is highly desirable because lower charge can be attained without paying the penalty of higher dust.

To the contrary, as depicted in TABLE 7, it is seen that surface treatment with silica SILICA S1 alone (Comparative Example 5) increases the absolute value of the rebuilt charge to mass relative to the control sample with no surface treatment (Comparative Example 4) from −52.5 to −61.8 μC/g. There is a significant lowering of the amount of rebuilt dust to 8.5 mg/g. It is desirable to lower the absolute Q/m of toners while maintaining the desirable features like flow properties of silica treated toners. The lower Q/m offers advantages of improved transfer and higher image densities. Surface treating toners with either a mixture of silica and TITANIA T1 titanium dioxide (Comparative Examples 6–8) or titanium dioxide alone (Comparative Example 9) lowers the 10 minute rebuilt Q/m significantly. However, this is achieved at a severe penalty in the throw-off (dust) amounts, which is undesirable. Thus, as Comparative Examples 5–8 indicate, as the amount of TITANIA T1 increases the 10-minute rebuilt Q/m decreases in absolute value from −61.8 μC/g to −24.9 μC/g while the amount of admix dust increases from 8.5 mg to 30.4 mg of dust per gram of added toner. Treatment with TITANIA T1 alone (Comparative Example 9) results in significantly low Q/m (−20.8 μC/g) and large amounts of dust (111.6 mg/g).

In addition, some of the following comparative examples use a combination of silica and titanium dioxide, but the titanium dioxide has a BET less than 70 $m^2/g$. As depicted in Table 7, it is seen that surface treatment with either a mixture of silica SILICA S2 and TITANIA T2 (Comparative Example 17) or surface treatment with titanium dioxide T2 (Comparative Example 18) lowers the 10 minute rebuilt Q/m significantly. However, this is achieved at a severe penalty in the throw-off (dust) amounts, which is undesirable. Increasing amounts of titania T2 in the silicaS2/titaniaT2 mixture decreases the 10-minute rebuilt Q/m value from −58.7 $\mu$C/g to −24.3 $\mu$C/g while the amount of admix dust increases from 4 mg to 86.6 mg of dust per gram of added toner. Treatment with TITANIA T2 alone (Comparative Example 18) results in significantly low Q/m (−34.2 $\mu$C/g) and large amounts of dust (179.1 mg/g). The trends are similar for the case of silica S2 and titania T3 mixtures. Increasing amounts of titania T3 in the silica S2/titania T3 mixtures decreases the 10-minute rebuilt Q/m value from −56.5 $\mu$C/g (example 19) to −20 $\mu$C/g (example 20) while the amount of admix dust increases from 6.6 mg to 132.2 mg of dust per gram of added toner. Treatment with titania T3 alone (example 21) results in significantly low Q/m (−42.1 $\mu$C/g) and large amounts of dust (229 mg).

Furthermore, Examples 22–25 demonstrate the combination of silica and titanium dioxide, with the titanium dioxide having a BET greater than 70 $m^2/g$, as well as a treatment composition only having the titanium dioxide with a BET greater than 70 $m^2/g$.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A developer, comprising:

a toner particle comprising a binder;

at least one titanium dioxide particle having a BET surface area of at least about 70 $m^2/g$ and a diameter of no more than about 20 nanometer;

at least one silica particle; and a carrier comprising a ferrite of the formula:

$$MO_6Fe_2O_3$$

where: M is barium, strontium or lead.

2. A developer according to claim 1 wherein the titanium dioxide particle has a BET surface area of at least 80 $m^2/g$.

3. A developer according to claim 1 wherein the titanium dioxide particle has a BET surface area of from 75–105 $m^2/g$.

4. A developer according to claim 1 wherein the titanium dioxide particle has a BET surface area of at least 70 $m^2/g$.

5. A developer according to claim 1 wherein the titanium dioxide particle has a diameter of no more than 15 nanometer.

6. A developer according to claim 1 wherein the titanium dioxide particle has a diameter of 7–12 nanometer.

7. A developer according to claim 1 wherein the titanium dioxide particle has a diameter of no more than 20 nanometer.

8. A developer according to claim 1 wherein the toner particle has an 8 micron volume average particle size and a charge mass ratio of 10–50 microCoulomb/g.

9. A developer according to claim 1 wherein the toner particle has a BET surface area to Coulter surface area ratio of about 1:1–about 5:1.

10. A developer according to claim 1 wherein the toner particle further comprises a pigment and a charge control agent.

11. A developer according to claim 1 wherein a surface of the toner particle is treated with at least one titanium dioxide particle having a BET surface area of at least about 70 $m^2/g$; and at least one silica particle.

12. A developer according to claim 1 comprising silica and titanium particles wherein the weight ratio of said silica particles to said titanium particles is about 1:0.1–about 1:2.

13. A developer according to claim 1 comprising silica and titanium particles wherein the weight ratio of said silica particles to said titanium particles is 1:0.5–1.5:1.

14. A developer according to claim 1 wherein the binder is a polyester.

15. A developer according to claim 1 wherein the developer has a rebuilt charge at 10 minutes of less than −50 microCoulomb/g and less than 5 mg of generated airborne dust per gram of admixed fresh toner after rebuilding.

16. A method of making a developer, comprising at least one toner particle, said method comprising:

treating the at least one toner particle with at least one titanium dioxide particle having a BET surface area of at least about 70 $m^2/g$ and having a diameter of no more than about 20 nanometer, and at least one silica particle; and combining the treated at least one toner particle with a carrier comprising a ferrite of the formula:

$$MO_6Fe_2O_3$$

where: M is barium, strontium or lead.

17. A developer according to claim 1 wherein the carrier has a volume average particle size of about 5–about 50 microns.

18. A developer according to claim 1 wherein the average particle size ratio of carrier to toner particles is from about 50:1–about 1:1.

19. A developer according to claim 1 wherein the carrier further comprises magnetic particles.

20. A developer comprising a toner particle according to claim 19 and further comprising a carrier of soft ferrite particles, hard ferrite particles, magnetite particles, or sponge iron particles.

21. A toner particle comprising:

at least one charge control agent of an aluminum salt of di-t-butylsalicyclic acid;

at least one titanium dioxide particle having a BET surface area of at least about 70 $m^2/g$ and having a diameter of no more than about 20 nanometer; and at least one silica particle.

22. A developer according to claim 1 wherein the toner particle further comprises at least one charge control agent of a quaternary ammonium salt, an aluminum salt of di-t-butylsalicyclic acid, or a zinc salt of di-t-butylsalicyclic acid.

23. A developer according to claim 1 wherein the toner particle is boron-free.

24. A developer according to claim 1 wherein the toner particle further comprises at least one charge control agent of an aluminum or zinc salt of di-t-butylsalicyclic acid.

* * * * *